US010757966B2

(12) United States Patent
Nappi et al.

(10) Patent No.: US 10,757,966 B2
(45) Date of Patent: Sep. 1, 2020

(54) METHOD AND APPARATUS FOR MANUFACTURING FILTERS FOR SMOKING ARTICLES

(71) Applicant: PHILIP MORRIS PRODUCTS S.A., Neuchatel (CH)

(72) Inventors: Leonardo Nappi, Hauterive (CH); Clement Besso, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 1303 days.

(21) Appl. No.: 14/758,371

(22) PCT Filed: Dec. 17, 2013

(86) PCT No.: PCT/EP2013/077003
§ 371 (c)(1),
(2) Date: Jun. 29, 2015

(87) PCT Pub. No.: WO2014/102094
PCT Pub. Date: Jul. 3, 2014

(65) Prior Publication Data

US 2015/0359260 A1 Dec. 17, 2015

(30) Foreign Application Priority Data

Dec. 31, 2012 (EP) ..... 12199828

(51) Int. Cl.
*A24D 3/00* (2020.01)
*A24D 3/02* (2006.01)
*A24D 3/04* (2006.01)

(52) U.S. Cl.
CPC ..... *A24D 3/0216* (2013.01); *A24D 3/0287* (2013.01); *A24D 3/045* (2013.01)

(58) Field of Classification Search
CPC ..... A24D 3/0283; A24D 3/043; A24D 3/045
(Continued)

(56) References Cited

U.S. PATENT DOCUMENTS 3,354,887 A * 11/1967 Hall ..... A24D 3/0262 131/282
3,602,232 A 8/1971 Grauvogel
(Continued)

FOREIGN PATENT DOCUMENTS

CN 101715305 5/2010
CN 102404999 4/2012
(Continued)

OTHER PUBLICATIONS

PCT Search Report and Written Opinion for PCT/EP2013/077003 dated Apr. 16, 2014 (12 pages).
(Continued)

*Primary Examiner* — Andrew M Tecco
*Assistant Examiner* — Eyamindae C Jallow
(74) *Attorney, Agent, or Firm* — Mueting Raasch Group

(57) ABSTRACT

There is provided a method and apparatus for manufacturing filters for smoking articles. The method comprises providing hollow tubes (309) of filter material. Each hollow tube has an outer diameter and an inner diameter. The method further comprises providing filter inserts (205). Each filter insert (205) has a first portion having a cross sectional dimension larger than the inner diameter of the hollow tube. The method further comprises inserting each filter insert (205) into a hollow tube (309) of filter material. During inserting, the first portion of the filter insert (205) engages with the hollow tube (309) to retain the filter insert in the hollow tube.

18 Claims, 3 Drawing Sheets

(58) Field of Classification Search
USPC ..... 131/338, 339; 493/4, 39
See application file for complete search history.

(56) References Cited

U.S. PATENT DOCUMENTS

| | | | | |
|---|---|---|---|---|
| 3,685,527 | A | 8/1972 | Sherrill | |
| 6,182,669 | B1 | 2/2001 | Van der Elst | |
| 6,918,867 | B2 | 7/2005 | Scherbarth | |
| 7,338,421 | B2 * | 3/2008 | Eusepi | A24D 3/0225 493/39 |
| 7,878,962 | B2 | 2/2011 | Karles | |
| 8,109,277 | B2 | 2/2012 | Li | |
| 8,353,302 | B2 | 1/2013 | Olegario | |
| 9,486,010 | B2 | 11/2016 | Barnes | |
| 2002/0119874 | A1 * | 8/2002 | Heitmann | A24C 5/475 493/39 |
| 2005/0066982 | A1 | 3/2005 | Clark | |
| 2006/0196513 | A1 * | 9/2006 | Atwell | A24C 5/475 131/58 |
| 2007/0235050 | A1 | 10/2007 | Li | |
| 2008/0216848 | A1 * | 9/2008 | Li | A24C 5/475 131/94 |
| 2008/0302373 | A1 | 12/2008 | Stokes | |
| 2010/0294290 | A1 | 11/2010 | Zhang | |
| 2011/0190105 | A1 | 8/2011 | Fallon | |
| 2011/0232659 | A1 | 9/2011 | Ercelebi | |
| 2012/0037172 | A1 | 2/2012 | Allen | |

FOREIGN PATENT DOCUMENTS

| | | | |
|---|---|---|---|
| EA | 200970846 | 2/2010 | |
| EA | 016243 | 3/2012 | |
| EP | 0649607 | 4/1995 | |
| EP | 1397967 | 3/2004 | |
| EP | 2432338 | 11/2010 | |
| FR | 2345092 | 10/1977 | |
| JP | 08-322538 | 12/1996 | |
| JP | 2008-539717 | 11/2008 | |
| JP | 2010-520755 | 6/2010 | |
| WO | WO 2005/077521 | 8/2005 | |
| WO | WO 2006/117697 | 11/2006 | |
| WO | WO 2007/010407 | 1/2007 | |
| WO | WO 2007/110650 | 10/2007 | |
| WO | WO 2007110650 A1 * | 10/2007 | A24D 3/043 |
| WO | WO 2008/059377 | 5/2008 | |
| WO | WO 2010/133334 | 11/2010 | |
| WO | WO 2011/117743 | 9/2011 | |
| WO | WO 2012/156705 | 11/2012 | |
| WO | WO 2013/000967 | 1/2013 | |

OTHER PUBLICATIONS

Office Action issued in Japan for Application No. 2015-550026 dated Oct. 16, 2017 (11 pages). English translation included.
Office Action issued in Russia for Application No. 2015131613 dated Dec. 19, 2017 (11 pages). English translation included.
Office Action issued in China for Application No. 201380067929 dated May 10, 2018 (17 pages). English translation included.
Office Action issued in Japan for Application No. 2015-550026 dated Sep. 20, 2018 (16 pages). English translation included.

* cited by examiner

METHOD AND APPARATUS FOR MANUFACTURING FILTERS FOR SMOKING ARTICLES

This application is a U.S. National Stage Application of International Application No. PCT/EP2013/077003, filed Dec. 17, 2013, which was published in English on Jul. 3, 2014 as International Patent Publication WO 2014/102094 A1. International Application No. PCT/EP2013/077003 claims priority to European Application No. 12199828.0 filed Dec. 31, 2012.

The present invention relates to a method and apparatus for manufacturing filters for smoking articles.

Combustible smoking articles, such as cigarettes, generally comprise shredded tobacco (usually in cut filler form) surrounded by a paper wrapper forming a tobacco rod. A cigarette is employed by a consumer by lighting one end thereof and burning the shredded tobacco rod. The consumer then receives mainstream smoke by drawing on the opposite end (mouth end or filter end) of the cigarette. The shredded tobacco may comprise a single type of tobacco or a blend of two or more types of tobacco.

A number of smoking articles in which an aerosol forming substrate, such as tobacco, is heated rather than combusted have also been proposed in the art. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool, they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

Smoking articles, particularly cigarettes, generally comprise a filter aligned in end-to-end relationship with a source of material, such as a tobacco rod or another aerosol forming substrate. Typically, the filter includes a plug of cellulose acetate tow attached to the tobacco rod or substrate by tipping paper. Ventilation of mainstream smoke can be achieved with a row or rows of perforations in the tipping paper about a location along the filter.

Ventilation may reduce both the particulate phase and the gas phase constituents of the mainstream smoke. However, smoking articles having high levels of ventilation may have levels of resistance-to-draw (RTD) which are too low to be considered acceptable to a consumer. The inclusion of, for example, one or more high density cellulose acetate filter segments may be used to increase to an acceptable level the overall RTD of smoking articles with high ventilation. However, high density cellulose acetate filter segments typically reduce particulate phase (for example, tar) deliveries while having little or no effect on gas phase (for example, carbon monoxide) deliveries. One way to solve this is to include a restrictor element or other filter element in the filter, which increases RTD without filtering the smoke. If used with high ventilation, a restrictor element can increase RTD while both the particulate phase and the gas phase constituents of the mainstream smoke are reduced.

It would be desirable to provide a method and apparatus for manufacturing filters for smoking articles, the filters including flow restricting elements, which are simpler than prior art manufacturing methods and apparatus. In particular, it would be desirable to provide a method and apparatus for manufacturing filters for smoking articles, the filters including flow restricting elements, in which fewer manufacturing steps are required compared with prior art arrangements.

According to a first aspect of the invention, there is provided a method for manufacturing filters for smoking articles, the method comprising the steps of: providing hollow tubes of filter material, each hollow tube having an outer diameter and an inner diameter; providing filter inserts, each filter insert having a first portion having a cross sectional dimension larger than the inner diameter of the hollow tubes; and inserting each filter insert into a hollow tube of filter material such that, during inserting, the first portion of the filter insert engages with the hollow tube to retain the filter insert in the hollow tube.

The method of the invention is relatively simple compared with methods described in the prior art because the method overcomes the resistance encountered as the filter insert is inserted into the hollow tube of filter material. There is no need for additional guiding means for inserting the filter insert into the hollow tube. For example, there is no need for a guiding sleeve within the bore of the hollow tube, as used in some methods described in the prior art. In addition, because the first portion of the filter insert engages with the inside surface of the hollow tube during the insertion, the filter insert will be retained in the hollow tube. Inserting means used to perform the step of inserting may be removed from the bore of the hollow tube without risk that the filter insert will be dislodged.

The filter made by the method of the invention comprises at least one filter insert disposed in a hollow tube of filter material. Air and smoke drawn through the filter are at least partially diverted around the filter insert or inserts and through a reduced cross section of filter material of the hollow tube. In particular, air and smoke drawn through the filter are at least partially diverted between the outer surface of the filter insert or inserts and the outer diameter of the hollow tube. Thus, the filter insert or inserts reduces the permeable cross-sectional area of the filter. Preferably, the cross-sectional area of the filter insert is between about 35% and about 90% of the cross-sectional area of the filter. That is, preferably, the permeable cross-sectional area of the filter is between about 10% and about 65% of the cross-sectional area of the filter. This may increase the RTD of the filter to a level which is acceptable to a consumer.

In one embodiment, the step of inserting comprises inserting two filter inserts simultaneously into each hollow tube of filter material, the two filter inserts being inserted from opposite ends of the hollow tube of filter material.

In this embodiment, preferably, each hollow tube of filter material has a length double that needed for a single smoking article. Thus, the method may be used to manufacture double length filters, which may subsequently be cut in two and incorporated into smoking articles. This is advantageous because twice as many filters may be manufactured in a given time period. In addition, such a method may be easily combined with conventional manufacturing techniques which typically use double length filters. Each double length filter may be attached to two tobacco rods (or other aerosol forming substrates), one at each end, and then cut into two, thereby creating two smoking articles. Thus, in this embodiment, the method may further comprise the step of cutting each hollow tube of filter material into two, to produce two filters, each filter comprising a hollow tube of filter material and a filter insert disposed therein. The step of cutting may be performed before or after a step of attaching the hollow tube of filter material to one or more aerosol forming substrates.

Moreover, because two filter inserts are inserted simultaneously into opposite ends of each hollow tube of filter material, the two forces used to insert the filter inserts are in opposite directions. Thus, the two forces counteract one another and assist in overcoming resistance which occurs because at least one cross sectional dimension of the filter inserts is larger than the inner diameter of the hollow tube. Because of these counteractive forces, there is no need for additional guiding means for inserting the filter inserts into the hollow tube. For example, there is no need for a guiding sleeve within the lumen of the hollow tube, as used in some methods described in the prior art. This advantage may alternatively be achieved by providing two adjacent single length hollow tubes, rather than one double length hollow tube.

In one embodiment, each filter insert has a second portion having a cross sectional dimension smaller than the inner diameter of the hollow tube, and during the step of inserting, the second portion of the filter insert is the leading portion.

The second portion of the filter insert, which has a cross sectional dimension smaller than the inner diameter of the hollow tube of filter material, is the leading portion as the filter insert is inserted into the hollow tube. The inner diameter $D_I$ of the hollow tube is the diameter of the lumen of the hollow tube. This allows for easy insertion of the filter insert, without the need for additional guiding means also being inserted into the lumen of the hollow tube. For example, there is no need for a guiding sleeve within the lumen of the hollow tube, as used in some methods described in the prior art. In this embodiment, the size and shape of the filter insert relative to the inner diameter $D_I$ of the hollow tube may be selected so that the second portion of the filter insert facilitates easy insertion of the filter insert into the hollow tube.

In this specification, the term "leading portion" is used to describe that portion of the filter insert which is leading with reference to the direction of insertion of the filter insert into the hollow tube. Preferably, the direction of insertion is parallel to the bore of the hollow tube.

Preferably, the filter insert is a flow restrictor. The filter insert may have any suitable shape. The first portion of the filter insert, which has a cross sectional dimension larger than the inner diameter of the hollow tube, ensures that the filter insert engages with the hollow tube, during and after insertion, so as to be retained in the hollow tube. The larger cross sectional dimension is measured perpendicular to the direction of insertion of the filter insert into the hollow tube. If the filter insert has a second portion having a cross sectional dimension smaller than the inner diameter of the hollow tube, the smaller cross sectional dimension is measured perpendicular to the direction of insertion of the filter insert into the hollow tube. The measurement is taken perpendicular to the direction of insertion between the two points of the filter insert furthest from one another. The two points that are furthest from one another may be at the same longitudinal position, or they may be at different longitudinal positions.

The filter insert may be solid or may include one or more air flow channels or may comprise a shell and a core. If the filter insert comprises a core and shell structure, the core may be empty. In some embodiments, the filter insert may include one or more air flow channels through the filter insert so that some of the air and smoke drawn through the filter is not diverted around the filter insert. In preferred embodiments, the filter insert forms a solid barrier comprising air-impermeable material to force the flow of smoke and air around the filter insert, as discussed herein. The filter insert may be manufactured using a fast continuous process such as a rotary-die process.

For example, the filter insert may be substantially cylindrical, prism-shaped, ovoid, ellipsoid, spheroid, conical, or teardrop-shaped. Preferably, the filter insert is a flow restricting bead. Preferably, the filter insert is a flow restricting ball. Preferably, however, the filter insert is substantially spherical. This may include filter inserts having a sphericity value of at least about 0.9, and preferably a sphericity value of approximately 1. Sphericity is a measure of how spherical an object is, with a perfect sphere having a sphericity value of 1. If the filter insert is substantially spherical, preferably, the cross sectional dimension of the first portion comprises the diameter of the sphere. If the filter insert is substantially spherical, preferably, the cross sectional dimension smaller than the inner diameter of the hollow tube comprises a (non-diameter) chord of the sphere. A spherical filter insert is easy to manufacture. In addition, the spherical shape allows easy insertion of the filter insert into the hollow tube of filter material. In addition, since a sphere is radially symmetric, the step of inserting the filter insert into a hollow tube of filter material may comprise inserting the filter insert at any orientation. The same RTD may be obtained regardless of the orientation that the filter insert adopts in the hollow tube.

Irrespective of the shape of the filter insert, a cross sectional dimension of the first portion of the filter insert is larger than the inner diameter of the hollow tube such that the filter insert is retained in the hollow tube. Friction resists the motion of the filter insert relative to the hollow tube and also retains the filter insert in the hollow tube. Kinetic friction occurs between the surface of the filter insert and the inner surface of the hollow tube as the filter insert is inserted into the hollow tube. The kinetic friction force provides resistance to the step of inserting the filter insert in the hollow tube of filter material. The size and shape of the filter insert relative to the inner diameter of the hollow tube may be selected to provide the desired level of kinetic friction and, hence, the desired level of resistance. Static friction resists relative lateral motion between the filter insert and the inner surface of the hollow tube when the filter insert is stationary within the hollow tube. Static friction therefore prevents the filter insert being dislodged from the hollow tube after insertion. The size and shape of the filter insert relative to the inner diameter of the hollow tube may be selected to provide the desired level of static friction between the filter insert and the hollow tube. If the filter insert is a sphere, the larger cross sectional dimension is preferably the diameter of the sphere. The (larger) cross sectional dimension of the first portion of the filter insert is measured in a direction which ensures that the filter insert is retained in the hollow tube. The cross sectional dimension of the first portion of the filter insert is measured in the direction of the inner and outer diameters of the hollow tube when the filter insert is disposed in the hollow tube.

If the filter insert has a second portion having a cross sectional dimension smaller than the inner diameter of the hollow tube, the smaller cross sectional dimension is measured in a direction which allows easy insertion of the filter insert into the hollow tube. The cross sectional dimension of the second portion of the filter insert is measured in the direction of the inner and outer diameters of the hollow tube when the filter insert is disposed in the hollow tube.

Preferably, the hollow tube has an outer diameter $D_O$ between about 3.8 mm and about 9.5 mm. More preferably, the hollow tube has an outer diameter $D_O$ between about 4.6 mm and about 7.8 mm. Even more preferably, the hollow tube has an outer diameter $D_O$ of about 7.7 mm. Preferably, the inner diameter $D_I$ of the hollow tube is between about 50% and about 90% of the outer diameter $D_O$. More preferably, the inner diameter $D_I$ is between about 60% and about 80% of the outer diameter $D_O$. Even more preferably, the inner diameter $D_I$ is between about 60% and about 70% of the outer diameter $D_O$. Even more preferably, the inner diameter $D_I$ is about 69% of the outer diameter $D_O$. Preferably, $D_0$-$D_I$> about 0.5 mm in order for sufficient structural integrity of the tube. In a preferred embodiment, the inner diameter $D_I$ of the hollow tube is about 5.3 mm. Most preferably, the outer diameter $D_O$ is about 7.7 mm and the inner diameter $D_I$ is about 5.3 mm. The inner diameter and outer diameter of the hollow tube are measured perpendicular to the longitudinal axis of the filter and smoking article. The cross sectional dimension of the first portion of the filter insert is measured in the direction of the inner and outer diameters of the hollow tube, that is perpendicular to the longitudinal axis of the filter and the smoking article. The cross sectional dimension of the second portion of the filter insert is measured in the direction of the inner and outer diameters of the hollow tube, that is perpendicular to the longitudinal axis of the filter and the smoking article.

The size and shape of the filter insert relative to the outer diameter $D_O$ of the hollow tube may be selected to provide the desired level of RTD. The cross sectional dimension of the first portion of the filter insert may be between about 60% and about 95% of the outer diameter of the hollow tube. If the filter insert and hollow tube have circular cross sections, this corresponds to the permeable cross sectional area being reduced by the filter insert to between about 10% and about 64% of cross sectional area of the hollow tube. Preferably, the cross sectional dimension of the first portion of the filter insert is between about 70% and about 90% of the outer diameter of the hollow tube. If the filter insert and hollow tube have circular cross sections, this corresponds to the permeable cross sectional area being reduced by the filter insert to between about 19% and about 51% of the cross sectional area of the hollow tube. More preferably, the cross sectional dimension of the first portion of the filter insert is between about 70% and about 80% of the outer diameter of the hollow tube. If the filter insert and hollow tube have circular cross sections, this corresponds to the permeable cross sectional area being reduced by the filter insert to between about 36% and about 51% of the cross sectional area of the hollow tube. Even more preferably, the cross sectional dimension of the first portion of the filter insert is between about 72% and about 78% of the outer diameter of the hollow tube. If the filter insert and hollow tube have circular cross sections, this corresponds to the permeable cross sectional area being reduced by the filter insert to between about 39% and about 48% of the cross sectional area of the hollow tube.

Preferably, the cross sectional dimension of the first portion of the filter insert is between about ($D_O$-3.0 mm) and about ($D_O$-0.2 mm). More preferably, the cross sectional dimension of the first portion of the filter insert is between about ($D_O$-2.8 mm) and about ($D_O$-0.4 mm). Even more preferably, the cross sectional dimension of the first portion of the filter insert is between about ($D_O$-1.5 mm) and about ($D_O$-0.8 mm). Even more preferably, the cross sectional dimension of the first portion of the filter insert is between about ($D_O$-1.2 mm) and about ($D_O$-1.0 mm). The cross sectional dimension of the first portion of the filter insert may be about ($D_O$-1.73 mm). The cross sectional dimension of the first portion of the filter insert may be about ($D_O$-0.58 mm). In one preferred embodiment, the cross sectional dimension of the first portion of the filter insert is about 5.55 mm. In another preferred embodiment, the cross sectional dimension of the first portion of the filter insert is about 6.0 mm. In another preferred embodiment, the cross sectional dimension of the first portion of the filter insert is about 7.15 mm.

The size and shape of the filter insert relative to the inner diameter $D_I$ of the hollow tube may be selected so that, during insertion, the first portion of the filter insert engages with the hollow tube and so that the filter insert is retained in the hollow tube by friction. The inner diameter of the hollow tube may be between about 75% and about 99% of the cross sectional dimension of the first portion of the filter insert. Preferably, the inner diameter of the hollow tube is between about 80% and about 95% of the cross sectional dimension of the first portion of the filter insert. Preferably, the inner diameter of the hollow tube is between about 88% and about 95% of the cross sectional dimension of the first portion of the filter insert. In one embodiment, the inner diameter of the hollow tube is about 88% of the cross sectional dimension of the first portion of the filter insert. In another embodiment, the inner diameter of the hollow tube is about 95% of the cross sectional dimension of the first portion of the filter insert.

Preferably, the filter has a length $L_F$ between about 15 mm and about 40 mm. Even more preferably, the filter has a length $L_F$ between about 18 mm and about 27 mm. In one embodiment, the filter has a length $L_F$ of about 27 mm. In a preferred embodiment, however, the filter has a length $L_F$ of about 21 mm. The reduced length is possible because the design of the filter according to the invention allows the desired RTD to be achieved in a shorter length.

Each hollow tube of filter material may a length double that needed for a single smoking article, for example for combining the method with conventional manufacturing techniques. For example, if the smoking article filter has a length $L_F$ between about 15 mm and about 40 mm, a double length hollow tube may have a length between about 30 mm and about 80 mm. If the smoking article filter has a length $L_F$ between about 18 mm and about 27 mm, a double length hollow tube may have a length between about 36 mm and about 54 mm. If the smoking article filter has a length $L_F$ of about 27 mm, a double length hollow tube may have a length of about 54 mm. If the smoking article filter has a length $L_F$ of about 21 mm, a double length hollow tube may have a length of about 42 mm.

The final longitudinal position of the centre of the filter insert in the hollow tube may be selected to provide the desired level of RTD. Preferably, the step of inserting the filter insert into the hollow tube of filter material comprises inserting the filter insert to a position in which the centre of the filter insert is at least about 6 mm from the downstream end of the filter. In this specification, the "centre" of the filter insert refers to the mid-point between the part of the filter insert disposed closest to the downstream end of the filter and the part of the filter insert disposed closest to the upstream end of the filter.

The step of inserting the filter insert into the hollow tube of filter material may comprise using inserting means to insert the filter insert, the length of the inserting means being substantially equal to the desired insertion distance. If more than one filter insert is desired in each hollow tube of filter material, the method may further comprise the step of inserting at least one additional filter insert into the hollow tube of filter material.

Preferably, the filter insert comprises an air-impermeable material. The term "air-impermeable material" is used throughout this specification to mean not allowing the passage of fluids, particularly air and smoke, through interstices or pores in the material. If the filter insert material is impermeable to air and smoke, air and smoke drawn through the filter are forced to flow around the filter insert and through a reduced cross section of filter material of the hollow tube. In particular, air and smoke drawn through the filter are forced between the outer surface of the filter insert and the outer diameter of the hollow tube. Thus, the filter insert reduces the permeable cross-sectional area of the filter. Preferably, the cross-sectional area of the filter insert is between about 35% and about 90% of the cross-sectional area of the filter. That is, preferably, the permeable cross-sectional area of the filter is between about 10% and about 65% of the cross-sectional area of the filter. This increases the RTD to a level which is acceptable to a consumer. Although the filter insert may comprise air-impermeable material, this does not preclude the filter insert having a shape which includes one or more air flow channels. In some cases the filter insert diverts all or substantially all of the smoke and air from flowing through the central portion of the filter, while in other cases the filter insert may force most of the smoke and air around the filter insert while still allowing a small amount of smoke and air through the filter insert, for example through one or more channels in the insert.

Diverting the flow to the edge of the filter may be particularly effective in increasing RTD since flow of air or smoke or both air and smoke may be predominantly through the central portion of the filter. The size and shape of the filter insert and the type of filter material of the hollow tube may be selected to affect the RTD in a desired manner. For example, when placed in a single filter segment without ventilation, the filter insert may be able to generate a RTD in the range of approximately 200 mm $H_2O$ (about 1960 Pa) to approximately 500 mm $H_2O$ (about 4900 Pa). Preferably, the filter insert is able to generate a RTD between approximately 250 mm $H_2O$ (about 2450 Pa) and approximately 400 mm $H_2O$ (about 3920 Pa).

Preferably, the filter insert is non-compressible. The term "non-compressible" is used throughout this specification to mean resistant to compression from any of: manual handling as the smoking article is removed from a pack, digital compression (that is, by a user's fingers on the filter), buccal compression (that is, by a user's lips or teeth on the mouth end of the filter) or the manual extinguishing ("stubbing out") process. That is, the term "non-compressible" is used to mean not deformable or destructible in the normal handling of a smoking article during manufacture and use.

Preferably, the filter insert has a compressive yield strength greater than about 8.0 kPa. More preferably, the filter insert has a compressive yield strength greater than about 12.0 kPa. The compressive yield strength is defined as the value of uniaxial compressive stress reached when there is a permanent deformation of the filter insert. Preferably, the filter insert has a compressive strength at a deformation of 10% greater than about 50.0 kPa. The compressive strength at a deformation of 10% is defined as the value of uniaxial compressive stress reached when there is a 10% deformation (that is, a 10% change in one cross sectional dimension) of the filter insert.

A filter insert having a compressive yield strength greater than about 8.0 kPa, or more preferably greater than about 12.0 kPa, or a compressive strength at a deformation of 10% greater than about 50.0 kPa, is not easily dislodged from the hollow tube. However, because the first portion of the filter insert has cross sectional dimension larger than the inner diameter of the hollow tube, the filter material of the hollow tube must be sufficiently compressible to allow the filter insert to be inserted into the hollow tube. The filter insert engages with the hollow tube, for example, by resistance created by frictional force between the filter insert and the inner surface of the deformable hollow tube, so as to retain the filter insert in the hollow tube.

The compressive yield strength and the compressive strength at a deformation of 10% may both be obtained experimentally by means of standardized test ISO 604. As will be appreciated by the skilled person, in this test, the specimen (filter insert) is compressed by compressive plates along an axis that corresponds to the pressure that a smokers' fingers would exert on the filter insert when the smoker is grasping the smoking article. The test is conducted at a constant rate of displacement until the load or deformation reaches a predetermined value. The load sustained by the specimen (filter insert) is measured during the procedure.

Preferably, the filter insert is a flow restrictor. Alternatively, the filter insert may be a capsule or any other filter element desired to be inserted into the hollow tube of filter material. The filter insert may comprise any suitable material or materials. Examples of suitable materials include, but are not limited to, gelatin or other types of hydrocolloids, alginate, carboxymethyl cellulose (CMC), cellulose, starch, polylactic acid, poly(butylene succinate) and its copolymers, poly(butylene adipate-co-terephthalate) and combinations thereof. The filter insert may comprise compressed tobacco, tobacco dust, ground tobacco, other flavourants or a combination thereof.

Preferably, the filter insert is formed from a dissolvable polymeric material formed of one or more water soluble polymers. More preferably the dissolvable polymeric material is formed of one or more water soluble thermoplastics. The term "dissolvable" means that the polymeric material is capable of dissolving into a solution with a water solvent. This is achieved through the use of one or more water soluble materials to form the material. The filter insert may be made entirely of the dissolvable polymeric material or the dissolvable polymeric material may be combined with inert components, such as inert inorganic fillers, which may or may not be dissolvable. The use of a dissolvable material to form the filter insert advantageously increases the rate of disintegration of the filter after it has been discarded. Alternatively or additionally, the filter insert may comprise a material which disperses into a suspension or colloid with the addition of water.

More preferably, the filter insert is formed from a biodegradable polymeric material. Preferred polymers are fully biodegradable as defined in the Aqueous Aerobic Biodegradation Test (Sturm test) outlined in European standard EN13432. Preferred biodegradable polymers include starch.

The filter material of the hollow tube may comprise any suitable material or materials. The type of filter material may be selected to provide the desired level of RTD. Examples of suitable materials include, but are not limited to, cellulose acetate, cellulose, reconstituted cellulose, polylactic acid, polyvinyl alcohol, nylon, polyhydroxybutyrate, thermoplastic material, such as starch, formed into an open cell foam, and combinations thereof. All or part of the filter may include activated carbon. The filter may include an adhesive or a plasticiser or a combination thereof to assist with retaining the filter insert in the hollow tube. This may also assist with the step of inserting each filter insert into a hollow tube of filter material. The filter material is preferably compressible to allow the filter insert to be inserted into the hollow tube.

Preferably, the filter material of the hollow tube is of low particulate efficiency. Preferably, the hollow tube comprises fibres of between approximately 1.5 denier per filament (dpf) and approximately 12.0 dpf. In a preferred embodiment, the hollow tube comprises medium diameter fibres of approximately 3.3 dpf. Preferably, the hollow tube comprises fibres of between approximately 15000 total denier (td) and approximately 50000 td. In a preferred embodiment, the hollow tube comprises medium diameter fibres of approximately 44000 td.

Preferably, each hollow tube of filter material comprises a filter wrapper circumscribing the filter material. A filter wrapper provides strength and structural rigidity for the hollow tube. This reduces the chance that the hollow tube will deform or be damaged as the filter insert is inserted into the hollow tube. This also reduces the chance that the hollow tube will deform on its outer surface around the region where the filter insert is disposed inside the hollow tube. The filter wrapper may comprise any suitable material. Preferably, the filter wrapper is a stiff plug wrap, for example comprising stiff paper or cardboard. The stiff paper or cardboard preferably has a basis weight greater than about 60 $gm^{-2}$. A stiff filter wrapper provides high structural rigidity. The filter wrapper may include a seam including one or more lines of adhesive. Preferably, the seam includes two lines of adhesive. This reduces the chance that the filter wrapper will split open as the filter insert is inserted into the hollow tube. One line of adhesive may comprise a hot melt adhesive. One line of adhesive may comprise polyvinyl alcohol.

Preferably, the step of inserting each filter insert into a hollow tube of filter material comprises supporting the hollow tube of filter material on a first rotatable drum.

That is, preferably, the hollow tube of filter material is supported on the first rotatable drum during the step of inserting. Preferably, the hollow tube of filter material is supported on the first rotatable drum before the step of inserting. Alternatively or additionally, the hollow tube of filter material is supported on the first rotatable drum after the step of inserting. Preferably, the first rotatable drum is rotating continuously during the step of inserting the filter insert into the hollow tube of filter material. The first drum may be an operating drum.

Preferably, the first rotatable drum includes a plurality of supports, for supporting a plurality of hollow tubes of filter material. Preferably, the supports are circumferentially spaced around the drum. Preferably, the supports are arranged to support hollow tubes such that the longitudinal axis of each hollow tube is substantially parallel to the axis of rotation of the drum. Each support may comprise a trough or depression in which a hollow tube may be received.

In a preferred embodiment, each hollow tube support comprises inserting means for performing the step of inserting the filter insert into the hollow tube. In that embodiment, as the drum rotates, each hollow tube is carried in the circumferential direction together with a respective inserting means. The inserting means and the hollow tube do not move relative to one another in the circumferential direction of the drum until the hollow tube is removed from the drum. The filter inserts may be supplied at a desired location or locations on the drum's rotational path. The inserting means may then perform the step of inserting the filter insert into the hollow tube of filter material. This is preferably performed while the drum is rotating. Then, the hollow tube of filter material, with the filter insert disposed therein, may be removed from the drum.

In an alternative embodiment, fewer inserting means than hollow tube supports are provided on the drum. In that embodiment, as the drum rotates, hollow tubes may rotate into position relative to inserting means. The inserting means and hollow tubes therefore move relative to one another in the circumferential direction of the drum in order to position successive hollow tubes relative to inserting means.

Supporting the hollow tube of filter material on the first rotatable drum may comprise providing a pressure difference between the inside and the outside of the first drum such that the hollow tube of filter material adheres to the drum. Apertures in the drum surface provide suction so that the hollow tube adheres to the drum.

If the step of inserting comprises inserting two filter inserts simultaneously into opposite ends of each hollow tube of filter material, the two opposite and counteracting forces may mean that a only a small pressure difference is required.

The method may further comprise supporting each hollow tube of filter material on a second rotatable drum before transferring each hollow tube of filter material to the first rotatable drum. In that case, supporting each hollow tube of filter material on the second rotatable drum may comprise providing a pressure difference between the inside and the outside of the second drum such that the hollow tube of filter material adheres to the second drum. Apertures in the drum surface provide suction so that the hollow tube adheres to the drum. The second drum may be a conveyor drum.

The method may further comprise transferring each hollow tube of filter material, with a respective filter insert disposed therein, from the first rotatable drum onto a third rotatable drum. That is, the method may further comprise, after the step of inserting each filter insert into a respective hollow tube, the step of transferring each hollow tube of filter material, with a respective filter insert disposed therein, from the first rotatable drum onto a third rotatable drum. In that case, supporting each hollow tube of filter material, with a respective filter insert disposed therein, on the third rotatable drum may comprise providing a pressure difference between the inside and the outside of the third drum such that the hollow tube of filter material adheres to the third drum. Apertures in the drum surface provide suction so that the hollow tube adheres to the drum. The third drum may be a collecting drum.

The method may further comprise delivering the filter inserts to means for inserting the filter inserts into the hollow tubes. The step of delivering the filter inserts may comprise delivering the filter inserts one at a time to the inserting means. If the step of inserting comprises inserting two filter inserts simultaneously into each hollow tube of filter material, the step of delivering the filter inserts may comprise delivering the filter inserts two at a time to the inserting means.

If the step of inserting each filter insert into a hollow tube of filter material comprises supporting the hollow tube on a first rotatable drum, the step of delivering the filter inserts may comprise delivering the filter inserts at a fixed delivery point. Thus, the hollow tubes of filter material may rotate towards the fixed delivery point. Once the hollow tube has rotated into a suitable position, at least one filter insert may be delivered.

The method may further comprise, before the step of inserting, positioning each filter insert relative to a hollow tube of filter material. The step of positioning may be performed by a sleeve or sleeves arranged to be positioned adjacent the hollow tube of filter material. Preferably, the sleeve or sleeves remain stationary relative to the hollow tube during the step of inserting. If the filter inserts are spherical, providing a pressure difference between the inside and the outside of a drum may not be particularly effective in adhering the filter inserts to the drum because of the limited contact area between the spherical filter inserts and the drum surface. Thus, positioning the filter inserts relative to the hollow tubes, for example using a sleeve or sleeves, may be particularly useful. If the filter insert has a second portion having a cross sectional dimension smaller than the inner diameter of the hollow tube, the step of positioning may comprise orienting the filter insert such that the second portion of the filter insert is the leading portion during inserting.

The method may further comprise the step of combining the hollow tube of filter material with one or more additional filter elements to form the filter. If the filter includes additional elements, the hollow tube with filter insert disposed therein is only a filter component of the smoking article filter, rather than the whole smoking article filter. The step of combining may be performed before the step of inserting a filter insert into each hollow tube. In that case, the step of combining comprises combining empty hollow tubes of filter material with one or more additional filter elements. This may preclude the embodiment in which two filter inserts are inserted into opposite ends of each hollow tube of filter material simultaneously. Alternatively, the step of combining may be performed after the step of inserting a filter insert into each hollow tube. In that case, the step of combining comprises combining the hollow tubes of filter material, with filter inserts disposed therein, with one or more additional filter elements. The additional filter element or elements may comprise a plug of filter material, a disc of filter material, a tubular element, or any other suitable filter element. Preferably, the additional filter elements are axially aligned with the hollow tube of filter material. Where the filter includes one or more additional filter elements, preferably the method comprises the step of overwrapping the hollow tube of filter material and the additional filter element or elements with a filter wrapper, such as a plug wrap. The overwrapping step may be performed before or after the step of inserting a filter insert into each hollow tube. The filter wrapper may reduce the chance of damage to the hollow tube as the filter insert is inserted into the hollow tube. The filter wrapper may reduce the chance that the hollow tube will deform on its outer surface around the region where the filter insert is disposed inside the hollow tube. Whether or not the hollow tube of filter material is combined with one or more additional filter elements, it may be preferable that the filter forms a mouth end cavity. This reduces visible, unsightly staining at the mouth end.

The method may further comprise the step of combining the hollow tube of filter material with an aerosol forming substrate to form a smoking article. The method may further comprise the step of combining the hollow tube of filter material with a tobacco rod to form a smoking article. The step of combining may be performed before the step of inserting a filter insert into each hollow tube. In that case, the step of combining comprises combining an empty hollow tube of filter material with a tobacco rod or other aerosol forming substrate. This may preclude the embodiment in which two filter inserts are inserted into opposite ends of each hollow tube of filter material simultaneously. Alternatively, the step of combining may be performed after the step of inserting a filter insert into each hollow tube. In that case, the step of combining comprises combining each hollow tube of filter material, with filter insert disposed therein, with a tobacco rod or other aerosol forming substrate. The method may further comprise the step of attaching the hollow tube of filter material and the aerosol forming substrate or tobacco rod with tipping material. The attaching step may be performed before or after the step of inserting a filter insert into each hollow tube. The tipping material may provide additional strength and structural rigidity for the hollow tube. The tipping material may reduce the chance of damage to the hollow tube as the filter insert is inserted into the hollow tube. The tipping material may reduce the chance of deformation on the outer surface of the hollow tube at the location where the filter insert is disposed in the hollow tube.

The tipping material may include a ventilation zone comprising perforations through the tipping material. The tipping material may include at least one row of perforations to provide ventilation of the mainstream smoke. If the filter includes a filter wrapper, preferably, the perforations extend through the filter wrapper. Alternatively, the filter wrapper may be permeable. The tipping material may be standard pre-perforated tipping material. Alternatively, the tipping material may be perforated (for example, using a laser) during the manufacturing process according to the desired number, size and position of the perforations. The number, size and position of the perforations may be selected to provide the desired level of ventilation. The ventilation, in conjunction with the filter insert and the filter material of the hollow tube, affects the desired level of RTD.

Preferably, the tipping material includes at least one circumferential row of perforations at least about 1 mm downstream of the centre of the filter insert. More preferably, the at least one circumferential row of perforations is at least about 3 mm downstream of the centre of the filter insert. Most preferably, the ventilation zone is placed downstream of the filter insert such that the ventilation air is introduced into a cavity or a filter element disposed downstream of the filter insert. This provides the optimal mix of ambient air drawn through the perforations and the air and smoke mixture flowing through the filter.

According to a second aspect of the invention, there is provided apparatus for manufacturing filters for smoking articles, each filter comprising a hollow tube of filter material, the hollow tube having an outer diameter and an inner diameter, and a filter insert disposed in the hollow tube of filter material, each filter insert having a first portion having a cross sectional dimension larger than the inner diameter of the hollow tube, the apparatus comprising: inserting means for inserting a filter insert into a hollow tube of filter material such that, during inserting, the first portion of the filter insert engages with the hollow tube to retain the filter insert in the hollow tube.

The inserting means preferably comprises at least one moveable piston for pushing the filter insert into the hollow tube of filter material.

In one embodiment, the inserting means is arranged to insert two filter inserts simultaneously into each hollow tube of filter material, the two filter inserts being inserted from opposite ends of the hollow tube of filter material. In that embodiment, the inserting means may comprise two moveable pistons, one at each end of the hollow tube of filter material.

Preferably, each hollow tube of filter material has a length double that needed for a single smoking article. Thus, the apparatus may be used to manufacture double length filters, which may subsequently be cut in two and incorporated into smoking articles. Thus, in this embodiment, the apparatus may further comprise cutting means for cutting each hollow tube of filter material into two, to produce two filters, each filter comprising a hollow tube of filter material and one filter insert disposed therein.

Moreover, because two filter inserts are inserted simultaneously into opposite ends of each hollow tube of filter material by the inserting means, the two forces used to insert the filter inserts are in opposite directions. Thus, the two forces counteract one another and assist in overcoming resistance which occurs because at least one cross sectional dimension of the filter inserts is larger than the inner diameter of the hollow tube. Because of these counteractive forces, there is no need for additional guiding means for inserting the filter inserts into the hollow tube.

In one embodiment, each filter insert has a second portion having a cross sectional dimension smaller than the inner diameter of the hollow tube, and the inserting means is arranged to insert the filter insert into the hollow tube such that the second portion of the filter insert is the leading portion during the inserting.

The second portion of the filter insert, which has a cross sectional dimension smaller than the inner diameter of the hollow tube of filter material, is the leading portion as the filter insert is inserted into the hollow tube. This allows for easy insertion of the filter insert, without the need for additional guiding means also being inserted into the bore of the hollow tube.

As already discussed in relation to the first aspect of the invention, the filter insert may have any desired size. As already discussed in relation to the first aspect of the invention, the filter insert may have any desired final longitudinal position in the hollow tube of filter material. As already discussed in relation to the first aspect of the invention, the filter insert may have any desired shape. However, in a preferred embodiment, the filter insert is substantially spherical.

As already discussed in relation to the first aspect of the invention, preferably, the filter insert comprises air-impermeable material. As already discussed in relation to the first aspect of the invention, preferably, the filter insert has a compressive yield strength greater than about 8.0 kPa, more preferably greater than about 12.0 kPa. As already discussed in relation to the first aspect of the invention, preferably, the filter insert has a compressive strength at a deformation of 10% greater than about 50.0 kPa. As already discussed in relation to the first aspect of the invention, the filter insert may comprise any suitable material or materials.

As already discussed in relation to the first aspect of the invention, the inner and outer diameters of the hollow tube of filter material may have any desired size. As already discussed in relation to the first aspect of the invention, the filter material of the hollow tube may comprise any suitable material or materials. In a preferred embodiment, each hollow tube of filter material comprises a filter wrapper circumscribing the filter material.

Preferably, the apparatus further comprises a first rotatable drum for supporting the hollow tubes of filter material as the filter inserts are inserted into the hollow tubes of filter material. The first drum may support the hollow tubes of filter material before the inserting. The first drum may support the hollow tubes of filter material after the inserting. The first drum may be an operating drum.

Preferably, the first rotatable drum includes a plurality of supports, for supporting a plurality of hollow tubes of filter material. Preferably, the supports are circumferentially spaced around the drum. Preferably, the supports are arranged to support hollow tubes such that the longitudinal axis of each hollow tube is substantially parallel to the axis of rotation of the drum. Each support may comprise a trough or depression in which a hollow tube may be received. Preferably, there is provided a pressure difference between the inside and the outside of the first drum such that the hollow tubes of filter material adhere to the drum.

The apparatus may further comprise a second rotatable drum for supporting the hollow tubes of filter material before the hollow tubes of filter material are transferred to the first rotatable drum. In that case, preferably, there is provided a pressure difference between the inside and the outside of the second drum such that the hollow tubes of filter material adhere to the second drum. The second drum may be a conveyor drum.

The apparatus may further comprise a third rotatable drum for supporting the hollow tubes of filter material, with filter inserts disposed therein, after the hollow tubes of filter material, with filter inserts disposed therein, are transferred from the first rotatable drum. In that case, preferably, there is provided a pressure difference between the inside and the outside of the third drum such that the hollow tubes of filter material, with filter inserts disposed therein, adhere to the third drum. The third drum may be a collecting drum.

The apparatus may further comprise delivery means for delivering the filter inserts to the inserting means. The delivery means may comprise at least one hopper for dispensing filter inserts to the inserting means. Preferably, the delivery means is arranged to deliver filter inserts in series to the inserting means. The delivery means may be arranged to deliver filter inserts one at a time to the inserting means. If the inserting means is arranged to insert two filter inserts simultaneously into each hollow tube of filter material, the delivery means may be arranged to deliver filter inserts two at a time to the inserting means.

If the inserting means comprises a moveable piston, preferably, the delivery means is arranged to deliver filter inserts between the piston and the hollow tube. If the inserting means comprises two moveable pistons, one at each end of the hollow tube, preferably, the delivery means is arranged to deliver filter inserts between each piston and the hollow tube.

If the apparatus comprises a first rotatable drum for supporting the hollow tubes of filter material as the filter inserts are inserted into the hollow tubes of filter material, preferably the delivery means is fixed. Thus the drum rotates relative to the delivery means. Thus, the hollow tubes of filter material may rotate towards the delivery means. Then, the delivery means may supply a filter insert or inserts once a hollow tube has rotated into a suitable position relative to the delivery means. Then, the inserting means may insert the filter insert or inserts into the hollow tube preferably at the same time as a subsequent hollow tube rotates into a suitable position relative to the delivery means.

The inserting means may comprise positioning means for positioning each filter insert relative to a hollow tube of filter material. The positioning means may comprise a sleeve or sleeves arranged to be positioned adjacent a hollow tube of filter material. The sleeve may have an internal diameter substantially the same size as the cross sectional dimension of the first portion of the filter insert. Thus, the sleeve can correctly position the filter insert relative to the lumen of the hollow tube, so that the filter insert can be inserted into the bore of the hollow tube. Preferably, the sleeve or sleeves remain stationary relative to the hollow tube during the step of inserting. If the filter inserts are spherical, providing a pressure difference between the inside and the outside of a drum may not be particularly effective in adhering the filter inserts to the drum because of the limited contact area between the spherical filter inserts and the drum surface. Thus, the positioning means for positioning the filter inserts relative to the hollow tubes may be particularly useful.

If the filter insert has a second portion having a cross sectional dimension smaller than the inner diameter of the hollow tube, the positioning means may be arranged to orient the filter insert such that the second portion of the filter insert is the leading portion during the inserting.

If the inserting means comprises at least one moveable piston, preferably, the positioning means is further arranged to guide the piston as it directs the filter insert into the hollow tube. If the positioning means comprises a sleeve, preferably the at least one moveable piston is received in the sleeve as it directs the filter insert into the hollow tube.

If the apparatus comprises a first rotatable drum, the positioning means may be provided on the drum. Each hollow tube support may comprise positioning means. Alternatively, fewer positioning means than hollow tube supports may be provided on the drum.

The apparatus may further comprise combining means for combining the hollow tubes of filter material with one or more additional filter elements to form the filters. The combining means may be arranged to combine the hollow tubes of filter material with one or more additional filter elements either before a filter insert is inserted into each hollow tube or after a filter insert is inserted into each hollow tube. The apparatus may further comprise means for overwrapping the hollow tube of filter material and the additional filter element or elements with a filter wrapper, such as a plug wrap. The means for overwrapping may be arranged to overwrap the hollow tube of filter material and the additional filter element or elements with a filter wrapper either before a filter insert is inserted into each hollow tube or after a filter insert is inserted into each hollow tube. The filter wrapper may reduce the chance of damage to the hollow tube as the filter insert is inserted into the hollow tube. The filter wrapper may reduce the chance that the hollow tube will deform on its outer surface around the region where the filter insert is disposed inside the hollow tube.

The apparatus may further comprise means for attaching the filter to an aerosol forming substrate to form a smoking article. The means for attaching may be arranged to attach each hollow tube of filter material to an aerosol forming substrate either before a filter insert is inserted into each hollow tube or after a filter insert is inserted into each hollow tube. As already discussed in relation to the first aspect of the invention, the aerosol forming substrate and filter may be attached with tipping material.

Filters manufactured using the method and apparatus of the present invention may advantageously be used in filter cigarettes and other smoking articles in which tobacco material is combusted to form smoke. Filters manufactured using the method and apparatus of the present invention may alternatively be used in smoking articles in which tobacco material is heated, rather than combusted, to form an aerosol. Filters manufactured using the method and apparatus of the present invention may also be used in smoking articles in which a nicotine-containing aerosol is generated from a tobacco material, tobacco extract, or other nicotine source, without combustion or heating.

Features described in relation to the method of the invention may also be applicable to the apparatus of the invention and features described in relation to the apparatus of the invention may also be applicable to the method of the invention.

The invention will be further described, by way of example only, with reference to the accompanying drawings in which.

Figure 1:
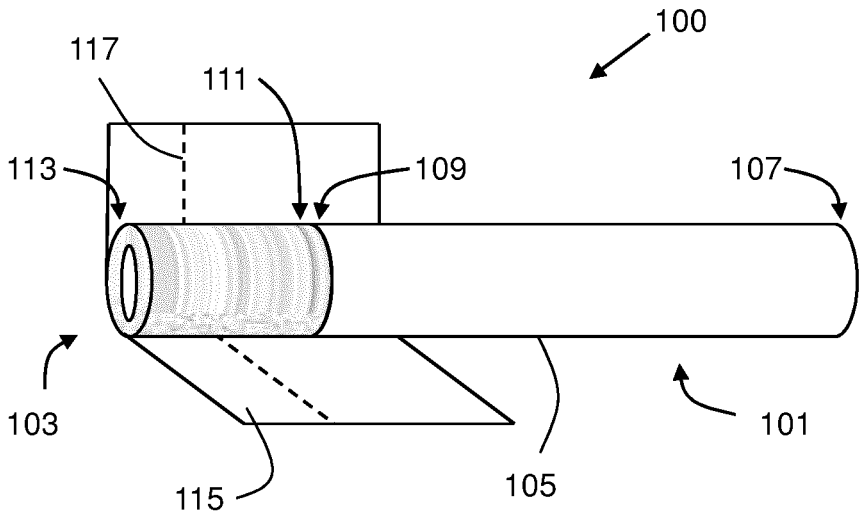
FIG. 1 is a perspective view of a smoking article including a filter manufactured according to an embodiment of the invention.

FIG. 1 is a perspective view of a smoking article 100 including a filter manufactured according to one embodiment of the invention. The smoking article 100 includes a generally cylindrical tobacco rod 101 and a generally cylindrical filter 103. The tobacco rod 101 and filter 103 are axially aligned in an end-to-end relationship, preferably abutting one another.

The tobacco rod includes an outer wrapper 105 circumscribing the smoking material. The outer wrapper 105 may be a porous wrapping material or paper wrapper. The tobacco is preferably a shredded tobacco or tobacco cut filler. The tobacco rod 101 has an upstream, lit end 107 and a downstream end 109. The filter 103 has an upstream end 111 and a downstream, mouth end 113. The upstream end 111 of the filter 103 is adjacent the downstream end 109 of the tobacco rod 101. Although not visible in FIG. 1, a filter insert is disposed in the filter 103.

The filter 103 is attached to the tobacco rod 101 by tipping material 115 which circumscribes the entire length of the filter 103 and an adjacent region of the tobacco rod 101. The tipping material 115 is shown partially removed from the smoking article in FIG. 1, for clarity. The tipping material 115 is typically a paper like product. However, any suitable material can be used. In this embodiment, the tipping material 115 includes a circumferential row of perforations 117 aligned with the filter 103. The perforations are provided for ventilation of the mainstream smoke.

In this specification, the "upstream" and "downstream" relative positions between smoking article components are described in relation to the direction of mainstream smoke as it is drawn from the tobacco rod 101 and through the filter 103.

Figure 2:
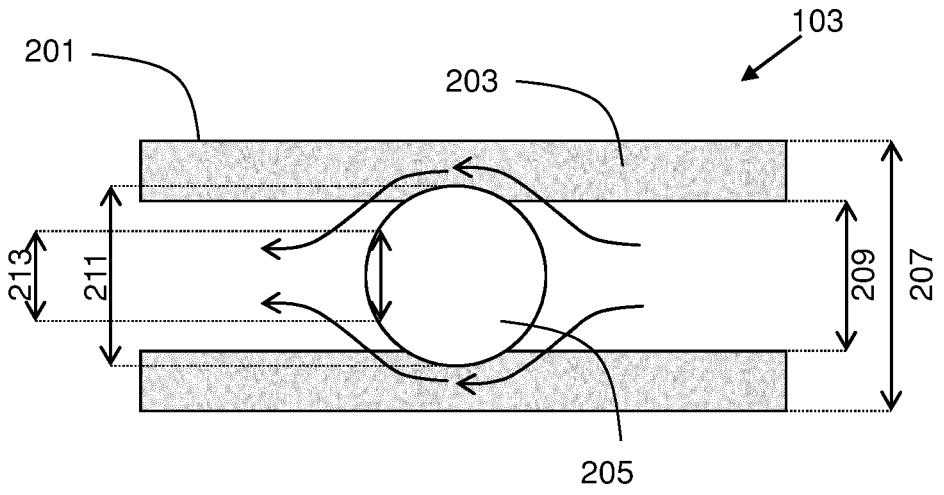
FIG. 2 is a cross sectional view of a filter manufactured according to an embodiment of the invention.

FIG. 2 is a cross sectional view of a filter 103 manufactured according to one embodiment of the invention. The filter 103 may be used in the smoking article of FIG. 1. In FIG. 2, the filter 103 comprises a hollow tube 201 of filter material 203. The hollow tube 201 has an outer diameter 207 and an inner diameter 209. The filter 103 further comprises a filter insert in the form of flow restricting bead 205. The flow restricting bead 205 may comprise air-impermeable material. The flow restricting bead 205 is substantially spherical, with a diameter 211 and a leading cross-sectional dimension 213. The flow restricting bead 205 is disposed in the hollow tube 201. Diameter 211 of the flow restricting bead 205 is slightly larger than inner diameter 209 of the hollow tube 201, so the flow restricting bead 205 causes the filter material adjacent the bead 205 to be slightly compressed, and the flow restricting bead 205 is retained in the hollow tube 201 by friction. Dimension 213 of the flow restricting bead 205 is slightly smaller than inner diameter 209 of the hollow tube 201, to assist with insertion of the flow restricting bead 205 into the hollow tube 201. That is, the curved leading surface of the flow restricting bead 205 assists in inserting the flow restricting bead 205 into the tube 201. As shown schematically by the arrows, air and smoke drawn through the filter 103 during use of the smoking article is forced to flow around the flow restricting bead 205 and through a reduced cross section of filter material 203 of the hollow tube 201. In FIG. 2, the outer diameter 207 of the hollow tube 201 is 7.7 mm, the inner diameter 209 of the hollow tube 201 is 5.3 mm, the diameter of the flow restricting bead 205 is 6.0 mm, the length of the filter 103 is 21 mm and the centre of the flow restricting bead 205 is 11 mm from the downstream end of the filter 103. When the filter is circumscribed by tipping material, the diameter of the filter may be 7.73 mm.

Figure 3:
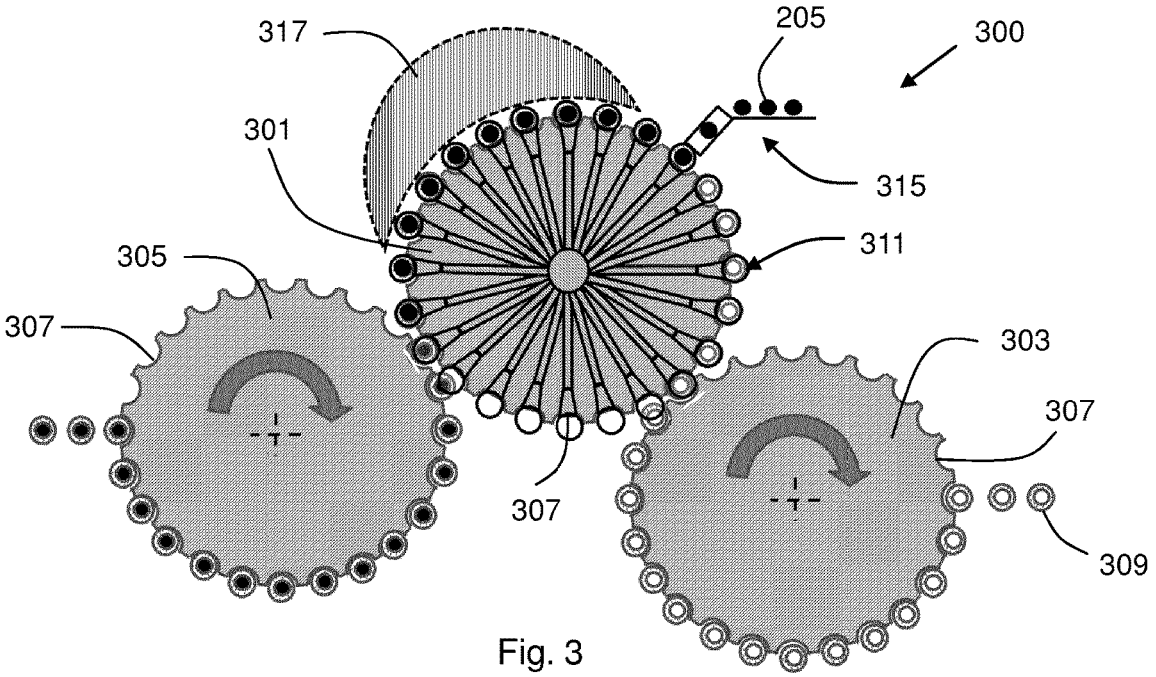
FIG. 3 is a cross sectional view of apparatus for manufacturing filters according to an embodiment of the invention.
Figure 4:
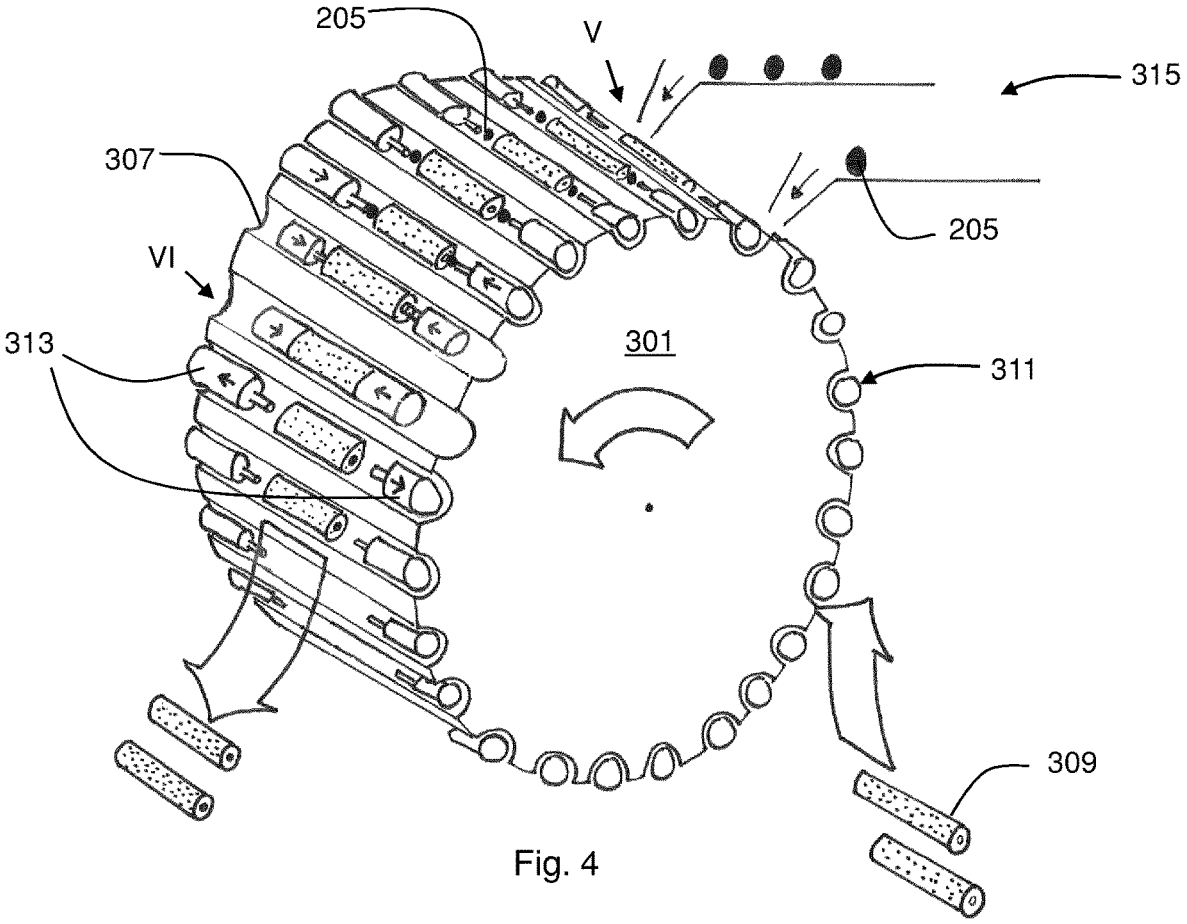
FIG. 4 is a perspective view of the operating drum of FIG. 3.

FIG. 3 is a cross sectional view of apparatus for manufacturing filters like that shown in FIG. 2, according to an embodiment of the invention. The apparatus 300 comprises an operating drum 301, a conveyor drum 303 and a collecting drum 305. FIG. 4 is a schematic perspective view of operating drum 301.

Referring to FIGS. 3 and 4, each drum 301, 303, 305 includes a plurality of supports in the form of troughs 307 around its circumference. Each trough 307 is suitable for supporting a hollow tube 309 of filter material. The operating drum 301 further comprises inserting means 311 provided in each trough 307. Each inserting means 311 comprises two pistons 313 and will be described further with reference to FIGS. 5 and 6. The apparatus further comprises delivery means 315 for providing flow restricting beads 205 (like that shown in FIG. 2), and a manifold 317.

Operation of apparatus 300 is as follows. Hollow tubes 309 of filter material are introduced via conveyor drum 303. Each hollow tube 309 is supported in a respective trough 307 on conveyor drum 303. Preferably, a vacuum is applied to conveyor drum 303 to secure the hollow tubes 309 in troughs 307. In the embodiment shown in FIGS. 3 and 4, conveyor drum 303 rotates in a clockwise direction.

The hollow tubes 309 are then transferred from conveyor drum 303 onto operating drum 301, which rotates in the opposite direction to conveyor drum 303. In this embodiment, operating drum 301 rotates in an anti-clockwise direction. Each hollow tube 309 is supported in a respective trough 307 on operating drum 301. Again, preferably, a vacuum is applied to operating drum 301 to secure the hollow tubes 309 in troughs 307. Inserting means 311 are also provided in each trough 307 on operating drum 301. The inserting means 311 comprises two pistons 313 and, when the hollow tubes 309 are transferred from conveyor drum 303, each hollow tube 309 is positioned in the centre of the trough, with a piston 313 on either side of hollow tube 309. At delivery means 315, flow restricting beads 205 are provided. Each trough 307 receives two flow restricting beads 205. One flow restricting bead 205 is dispensed between the first piston 313 and the hollow tube 309 and another flow restricting bead 205 is dispensed between the second piston 313 and the hollow tube 309. As operating drum 301 rotates, the pistons 313 each move towards the hollow tube 309 to insert the flow restricting beads 205 into the hollow tubes 309. One flow restricting bead is received in each end of each hollow tube 309. The manifold 317 (not shown in FIG. 4 for clarity) is provided to prevent movement, damage or deformation of the hollow tubes relative to the operating drum as the flow restricting beads are being inserted.

The process of inserting the flow restricting beads 205 into the hollow tubes will be described further with reference to FIGS. 5 and 6. Two positions V and VI are indicated in FIG. 4. Position V denotes a position at which the flow restricting beads 205 are dispensed from delivery means 315 and will be described further with reference to FIG. 5. Position VI denotes a position at which the flow restricting beads 205 have been inserted into the hollow tubes, and the pistons 313 are fully extended into the hollow tubes 309, and will be described further with reference to FIG. 6.

The hollow tubes 309, each with two flow restricting beads 205 disposed therein, are then transferred from operating drum 301 onto collecting drum 305, which rotates in the opposite direction to operating drum 301. In this embodiment, collecting drum 305 rotates in a clockwise direction. Each hollow tube 309, with flow restricting beads 205 disposed therein, is supported in a respective trough 307 on collecting drum 305. Again, preferably, a vacuum is applied to collecting drum 305 to secure the hollow tubes 309 in troughs 307.

Figure 5:
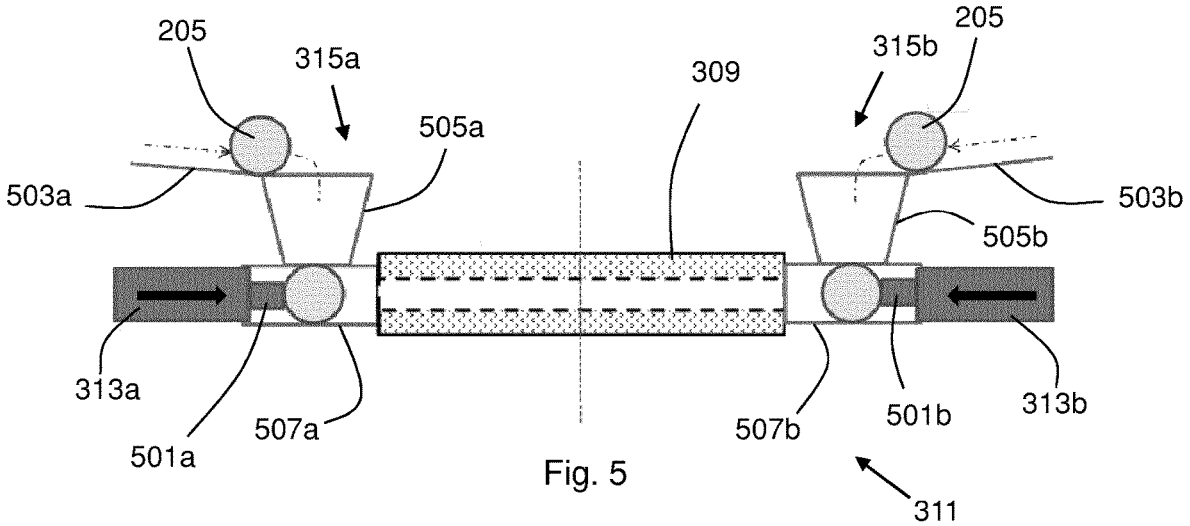
FIG. 5 is a view of the inserting means of FIGS. 3 and 4 in a first position.
Figure 6:
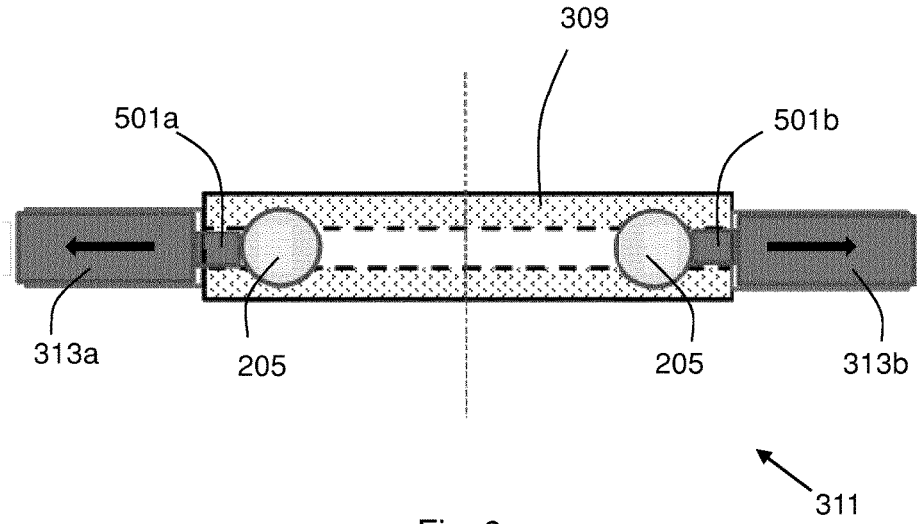
FIG. 6 is view of the inserting means of FIGS. 3 and 4 in a second position.

FIGS. 5 and 6 show operation of the inserting means 311 provided in each trough 307 on operating drum 301. As already discussed, in this embodiment, each inserting means comprises two pistons 313 (denoted 313*a* and 313*b* in FIGS. 5 and 6). Each piston comprises a piston head (denoted 501*a* and 501*b* in FIGS. 5 and 6). The hollow tube 309 of filter material is positioned in the trough 307 such that piston 313*a* is on a first side of the hollow tube 309 and piston 313*b* is on a second side of the hollow tube 309. FIG. 5 shows the position of pistons 313*a*, 311*b* before the flow restricting beads 205 are inserted into the hollow tubes 309, for example at position V in FIG. 4. FIG. 6 shows the position of pistons 313*a*, 313*b* after the flow restricting means have been inserted into the hollow tubes 309, for example at position VI in FIG. 4.

FIG. 5 also shows delivery means 315 for supplying flow restricting beads 205. In the embodiment shown in FIG. 5, two delivery means are provided, denoted 315*a* and 315*b*. Delivery means 315*a* is aligned to dispense a flow restricting bead 205 between piston 313*a* and the first end of the hollow tube 309. Delivery means 315*b* is aligned to dispense a flow restricting bead 205 between piston 313*b* and the first end of the hollow tube 309. Delivery means 315*a* comprises delivery ramp 503*a* and dispensing hopper 505*a*. Delivery means 315*b* comprises delivery ramp 503*b* and dispensing hopper 505*b*. Alternatively, a single hopper may be provided for both delivery means. Inserting means 311 also comprises positioning means in the form of sleeves 507*a*, 507*b*. Sleeve 507*a* is positioned between piston 313*a* and the first end of the hollow tube 309. The sleeve 507*a* has an aperture to receive a flow restricting bead 205 from dispensing hopper 505*a*. The inner diameter of sleeve 507*a* is preferably slightly larger than the piston 313*a* and the diameter 211 of flow restricting bead 205. Similarly, sleeve 507*b* is positioned between piston 313*b* and the second end of the hollow tube 309. The sleeve 507*b* has an aperture to receive a flow restricting bead 205 from dispensing hopper 505*b*. The inner diameter of sleeve 507*b* is preferably slightly larger than the piston 313*b* and the diameter 211 of flow restricting bead 205. Preferably, sleeves 507*a*, 507*b* are provided in each trough 307 on operating drum 301, although this is not shown in FIG. 4 for clarity.

As the operating drum 301 rotates between position V and position VI, the pistons 313*a*, 313*b* move in the direction of the arrows shown in FIG. 5. Piston 313*a* is received in sleeve 507*a* and forces the flow restricting bead 205 into the bore of the hollow tube 309 at the first end. The piston heads 501*a*, 501*b* each have a diameter slightly smaller than the inner diameter 209 of hollow tube 309, such that they can be received in the bore of the hollow tube, with a small margin of clearance. The piston head 501*a* is received in the bore of the hollow tube 309 and the length of the piston head 501*a* is selected depending on the desired position of the flow restricting bead 205 in the first end of the hollow tube 309. Similarly, piston 313*b* is received in sleeve 507*b* and forces the flow restricting bead 205 into the bore of the hollow tube 309 at the second end. The piston head 501*b* is received in the bore of the hollow tube 309 and the length of the piston head 501*b* is selected depending on the desired position of the flow restricting bead 205 in the second end of the hollow tube 309. Once the pistons 313*a*, 313*b* are fully extended (FIG. 6), the flow restricting beads 205 are disposed in the desired positions within the hollow tube 309. The pistons may then be withdrawn as shown by the arrows in FIG. 6.

In the embodiment illustrated in FIGS. 3, 4, 5 and 6, each hollow tube 309 of filter material has a length double that needed for a smoking article. Therefore, after the flow restricting beads 205 have been inserted into the hollow tubes 309, the hollow tubes 309 may be cut in two, thereby providing individual filters for smoking articles. The hollow tubes 309 may be cut in two prior to being combined with other elements into a smoking article. Alternatively, the double length hollow tubes 309 may be attached two tobacco rods, one at the first end and one at the second end, with tipping paper and subsequently cut to provide two finished smoking articles.

Because the diameter 211 of the flow restricting beads 205 is larger than the inner diameter 209 of the hollow tubes 309, inserting a flow restricting bead 205 into a hollow tube 309 of filter material must overcome resistance due to friction. In the embodiment illustrated in FIGS. 3, 4, 5 and 6, this resistance is overcome in two ways. Firstly, the two flow restricting beads 205 are inserted into opposite ends of a hollow tube 309 simultaneously. The two forces exerted by pistons 313*a* and 313*b* are in opposite directions and counteract one another to assist in overcoming resistance. Thus, although the sleeves 507*a*, 507*b* are provided adjacent the hollow tube 309 to receive the pistons 313*a*, 313*b* and to correctly position the flow restricting beads 205 relative to the hollow tube 309, there is no need for an additional guiding sleeve within the hollow tube lumen. Secondly, the flow restricting beads 205 are spherical in shape and this means that the leading surface of a flow restricting bead 205, as it is inserted into the hollow tube 309, is curved. The flow restricting bead 205 has a leading cross sectional diameter 213 smaller than the inner diameter 209 of the hollow tube 309. This facilitates insertion of the flow restricting bead 205, even though the bead diameter 211 is larger than the inner diameter 209 of the hollow tube 309. In this embodiment, the material of the hollow tube 309 is sufficiently compressible and elastic to allow the bead to be inserted into the hollow tube bore. This may be achieved with several alternative shapes for the filter insert, for example, but not limited to, ovoid, ellipsoid, conical and teardrop-shaped. The manifold 317 (not shown in FIG. 4 for clarity) is provided to reduce the chance of movement or deformation of the hollow tubes as the flow restricting beads are being inserted.

However, it is possible that the resistance due to friction may be overcome by only one of these two mechanisms. For example, the arrangement shown in FIGS. 3 and 4 may be used to insert filter inserts which are cylindrical in shape. The two forces exerted by pistons 313*a* and 313*b* will counteract one another and assist in overcoming the resistance faced when inserting the cylindrical filter inserts into the hollow tubes of filter material. For example, a spherical flow restricting bead 205 may be used but the flow restricting beads may be inserted individually, rather than in the double arrangement shown in FIGS. 3, 4 5 and 6. The curved leading surface of the flow restricting bead will assist in overcoming the resistance due to friction when inserting the flow restricting bead into a hollow tube of filter material. In that case, the flow restricting beads may be inserted either before or after the hollow tubes of filter material are combined with tobacco rods, or other aerosol forming substrates, to form smoking articles. Therefore, the method and apparatus of the invention may be simpler and more straightforward than methods and apparatus described in the prior art.

The invention claimed is:

1. A method for manufacturing filters for smoking articles, the method comprising the steps of:

providing hollow tubes of filter material, each hollow tube having an outer diameter and an inner diameter;

providing filter inserts, each filter insert having a first portion having a cross sectional dimension larger than the inner diameter of the hollow tubes; and inserting each filter insert into a hollow tube of filter material, wherein the step of inserting comprises positioning each filter insert relative to a hollow tube of filter material by positioning each filter insert within a sleeve or sleeves adjacent a hollow tube of filter material such that, during inserting, the first portion of the filter insert engages with the hollow tube to retain the filter insert in the hollow tube, wherein the filter insert is substantially spherical, the cross sectional dimension of the first portion of the filter insert being a diameter of the substantially spherical filter insert.

2. A method according to claim 1, wherein the step of inserting comprises inserting two filter inserts simultaneously into each hollow tube of filter material, the two filter inserts being inserted from opposite ends of the hollow tube of filter material.

3. A method according to claim 1, wherein each filter insert has a second portion having a cross sectional dimension smaller than the inner diameter of the hollow tube, and wherein, during the step of inserting, the second portion of the filter insert is the leading portion.

4. A method according to claim 1, wherein each hollow tube of filter material comprises a filter wrapper circumscribing the filter material.

5. A method according to claim 1, wherein the step of inserting each filter insert into the hollow tube of filter material comprises supporting the hollow tube of filter material on a first rotatable drum.

6. A method according to claim 5, wherein supporting the hollow tube of filter material on the first rotatable drum comprises providing a pressure difference between the inside and the outside of the first drum such that the hollow tube of filter material adheres to the drum.

7. A method according to claim 5, wherein the first rotatable drum is rotating continuously during the step of inserting the filter insert into the hollow tube of filter material.

8. Apparatus for manufacturing filters for smoking articles, each filter comprising a hollow tube of filter material, the hollow tube having an outer diameter and an inner diameter, and first and second filter inserts disposed in the hollow tube of filter material, each of the first and second filter inserts having a first portion having a cross sectional dimension larger than the inner diameter of the hollow tube, the apparatus comprising:

a first piston configured to engage and push the first filter insert into the hollow tube of filter material such that, during inserting, the first portion of the first filter insert engages with the hollow tube to retain the first filter insert in the hollow tube;

a second piston configured to engage and push the second filter insert into the hollow tube of filter material such that, during inserting, the first portion of the second filter insert engages with the hollow tube to retain the second filter insert in the hollow tube, wherein the first and second pistons are arranged to insert the first and second filter inserts from opposite ends of the hollow tube of filter material, wherein the apparatus is configured to cause the first and second pistons to insert the first and second filter inserts simultaneously into the hollow tube of filter material;

a first sleeve configured to receive the first filter inserts, wherein the first sleeve is positionable relative to the hollow tube of filter material such that actuation of the first piston causes the first filter insert to be pushed from within the first sleeve into the hollow tube of filter material; and a second sleeve configured to receive the second filter insert, wherein the second sleeve is positionable relative to the hollow tube of filter material such that actuation of the second piston causes the second filter insert to be pushed from within the second sleeve into the hollow tube of filter material.

9. Apparatus according to claim 8, wherein each of the first and second filter inserts have a second portion having a cross sectional dimension smaller than the inner diameter of the hollow tube, and wherein the apparatus is configured to cause the first and second pistons to insert the first and second filter inserts into the hollow tube such that the second portion of each of the first and second filter inserts are the leading portion during the inserting.

10. Apparatus according to claim 8, wherein the filter insert is substantially spherical, the cross sectional dimension of the first portion of each of the first and second filter inserts are a diameter of the substantially spherical filter insert.

11. Apparatus according to claim 8, wherein the hollow tube of filter material comprises a filter wrapper circumscribing the filter material.

12. Apparatus according to claim 8, further comprising a first rotatable drum for supporting the hollow tube of filter material as the first and second filter inserts are inserted into the hollow tubes of filter material.

13. Apparatus according to claim 8, further comprising a hopper configured to deliver the first and second filter inserts relative to the first and second pistons.

14. Apparatus according to claim 8, wherein the first and second sleeves are positionable adjacent a hollow tube of filter material.

15. Apparatus according to claim 8 further comprising:

first rotatable drum for supporting the hollow tube of filter material as the first and second filter inserts are inserted into the hollow tube of filter material; and a hopper configured to deliver the first and second filter inserts relative to the first and second pistons.

16. Apparatus for manufacturing filters for smoking articles, each filter comprising a hollow tube of filter material, the hollow tube having an outer diameter and an inner diameter, and first and second filter inserts disposed in the hollow tube of filter material, each of the first and second filter inserts having a first portion having a cross sectional dimension larger than the inner diameter of the hollow tube, the apparatus comprising:

a first piston configured to engage and push the first filter insert into the hollow tube of filter material such that, during inserting, the first portion of the first filter insert engages with the hollow tube to retain the filter insert in the hollow tube;

a second piston configured to engage and push the second filter insert into the hollow tube of filter material such that, during inserting, the first portion of the second filter insert engages with the hollow tube to retain the second filter insert in the hollow tube, wherein the first and second pistons are arranged to insert the first and second filter inserts from opposite ends of the hollow tube of filter material, wherein the apparatus is configured to cause the first and second pistons to insert two filter inserts simultaneously into the hollow tube of filter material a first sleeve configured to receive the first filter insert, wherein the first sleeve is positionable relative to the hollow tube of filter material such that actuation of the first piston causes the first filter insert to be pushed from within the first sleeve into the hollow tube of filter material, a second sleeve configured to receive the second filter insert, wherein the second sleeve is positionable relative to the hollow tube of filter material such that actuation of the second piston causes the second filter insert to be pushed from within the second sleeve into the hollow tube of filter material; and a hopper configured to deliver the first and second filter inserts relative to the first and second sleeves.

17. Apparatus according to claim 16 further comprising a first rotatable drum for supporting the hollow tube of filter material as the first and second filter inserts are inserted into the hollow tubes of filter material.

18. Apparatus according to claim 16, wherein the first and second sleeves are positionable adjacent the hollow tube of filter material for positioning the first and second filter inserts relative to the hollow tube of filter material.

* * * * *